US011067332B2

(12) United States Patent
Wang et al.

(10) Patent No.: US 11,067,332 B2
(45) Date of Patent: Jul. 20, 2021

(54) REFRIGERATOR AND DRAWER ASSEMBLY THEREOF

(71) Applicants: HAIER SMART HOME CO., LTD., Shandong (CN); QINGDAO HAIER SPECIAL REFRIGERATION ELECTRIC APPLIANCE CO., LTD., Shangdong (CN)

(72) Inventors: Jing Wang, Qingdao (CN); Xiaobing Zhu, Qingdao (CN); Haoquan Liu, Qingdao (CN); Dong Guo, Qingdao (CN)

(73) Assignees: HAIER SMART HOME CO., LTD., Qingdao (CN); QINGDAO HAIER SPECIAL REFRIGERATION ELECTRIC APPLIANCE CO., LTD., Qingdao (CN)

( * ) Notice: Subject to any disclaimer, the term of this patent is extended or adjusted under 35 U.S.C. 154(b) by 0 days.

(21) Appl. No.: 16/977,686

(22) PCT Filed: Dec. 12, 2018

(86) PCT No.: PCT/CN2018/120693
§ 371 (c)(1),
(2) Date: Sep. 2, 2020

(87) PCT Pub. No.: WO2019/165823
PCT Pub. Date: Sep. 6, 2019

(65) Prior Publication Data

US 2020/0393195 A1 Dec. 17, 2020

(30) Foreign Application Priority Data

Mar. 2, 2018 (CN) ..... 201810175441.3

(51) Int. Cl.
*F25D 25/02* (2006.01)
*F25D 23/06* (2006.01)

(52) U.S. Cl.
CPC ..... *F25D 25/025* (2013.01); *F25D 23/067* (2013.01)

(58) Field of Classification Search
CPC ..... F25D 25/025; F25D 23/067
See application file for complete search history.

(56) References Cited

U.S. PATENT DOCUMENTS 5,040,856 A * 8/1991 Wilkins ..... F25D 25/025 312/402
8,864,250 B2 * 10/2014 Anderson ..... F25D 25/025 312/404

(Continued)

FOREIGN PATENT DOCUMENTS

CN 201051979 Y 4/2008
CN 103148672 A 6/2013

(Continued)

OTHER PUBLICATIONS

International Search Report for PCT/CN2018/120693 dated Feb. 15, 2019, ISA/CN (4 pages).

(Continued)

*Primary Examiner* — Kimberley S Wright
(74) *Attorney, Agent, or Firm* — Alston & Bird LLP

(57) ABSTRACT

A drawer assembly includes: drawers, arranged in a storage compartment of the refrigerator in a way of being capable of being pushed and pulled forward and rearward between a front extreme position and a rear extreme position; and two support assemblies in left-right parallel arrangement. Each of the support assemblies includes a support frame. The support frame is fixed to an inner wall of the storage compartment, is provided on an inner side with a first slideway extending forward and rearward, and is provided (Continued)

on a rear portion of the inner side with an elastic tongue. A left sidewall and a right sidewall of the drawer are respectively mounted on the first sideway of the support frame of one of the support assemblies in a forward and rearward slidable way.

9 Claims, 13 Drawing Sheets

(56) References Cited

U.S. PATENT DOCUMENTS

| | | | | |
|---|---|---|---|---|
| 9,488,405 | B2 * | 11/2016 | Lee | F25D 25/025 |
| 2009/0309472 | A1 * | 12/2009 | Park | F25D 25/025 312/401 |
| 2011/0095670 | A1 * | 4/2011 | Cho | F25D 25/025 312/405.1 |
| 2016/0209107 | A1 * | 7/2016 | Choi | F25D 25/025 |
| 2017/0198963 | A1 * | 7/2017 | Hanson | F25D 25/025 |
| 2020/0224959 | A1 * | 7/2020 | Wantland | A47B 88/467 |

FOREIGN PATENT DOCUMENTS

| | | | | |
|---|---|---|---|---|
| CN | 204421472 | U * | 6/2015 | F25D 25/025 |
| CN | 205493181 | U | 8/2016 | |
| CN | 106979644 | A | 7/2017 | |
| CN | 206600958 | U * | 10/2017 | |
| CN | 108050759 | A * | 5/2018 | F25D 11/02 |
| CN | 108204708 | A | 6/2018 | |
| CN | 208059395 | U | 11/2018 | |
| JP | H08219634 | A | 8/1996 | |
| JP | 5320228 | B2 * | 10/2013 | |
| RU | 2477826 | C2 | 3/2013 | |
| RU | 2529916 | C2 | 10/2014 | |

OTHER PUBLICATIONS

Written Opinion for PCT/CN2018/120693 dated Feb. 15, 2019, ISA/CN (8 pages).

1st Search Report of priority application CN201810175441.3 dated Jul. 15, 2019 (3 pages).

1st Office Action of priority application CN201810175441.3 dated Jul. 24, 2019 (3 pages).

Search Report for Russian Application No. 2020132270 completed Dec. 20, 2020, with English translation (4 pages).

* cited by examiner

REFRIGERATOR AND DRAWER ASSEMBLY THEREOF

CROSS-REFERENCE TO RELATED APPLICATIONS

The present application is a national phase entry of International Application No. PCT/CN2018/120693, filed Dec. 12, 2018, which claims priority to Chinese Patent Application No. 201810175441.3, filed Mar. 2, 2018, which are incorporated herein by reference in their entirety.

FIELD OF THE INVENTION

The present invention relates to a refrigeration and freezing device, and more particularly relates to a refrigerator and a drawer assembly thereof.

BACKGROUND OF THE INVENTION

A drawer of a refrigerator is generally arranged in a storage compartment in a way of being capable of being pushed and pulled. A slide rail device is arranged iii on an inner wall of the storage compartment, and is beneficial to the forward and rearward movement of the drawer. However, for convenience, a user often closes the drawer with greater pushing force, so that when the drawer is about to be closed, a front end wall of the drawer collides with a refrigerator body, thus generating great noise and damaging articles in the drawer. The drawer is easy to break down due to long-term collision, so that the service life of the drawer is shortened.

BRIEF DESCRIPTION OF THE INVENTION

One objective of the present invention is to overcome at least one defect in the prior art and to provide a refrigerator with a novel and simple structure and a drawer assembly thereof. When a drawer is about to be closed, the rearward movement of the drawer is cushioned, so that the drawer is stably closed.

Another objective of the present invention is to realize power-assisted automatic closing of the drawer.

A yet another objective of the present invention is to give out a prompt sound during the closing of the drawer, so as to prompt a user to loosen the grip after the prompt sound is heard, so that the automatic subsequent closing process of the drawer is completed.

In one aspect, the present invention provides a drawer assembly for a refrigerator, including:

drawers, arranged in a storage compartment of the refrigerator in a way of being capable of being pushed and pulled forward and rearward between a front extreme position and a rear extreme position; and two support assemblies in left-right parallel arrangement. Each of the support assemblies includes a support frame. The support frame is fixed to an inner wall of the storage compartment, is provided on an inner side with a first slideway extending forward and rearward, and is provided on a rear portion of the inner side with an elastic tongue.

A left sidewall and a right sidewall of the drawer are respectively mounted on the first sideway of the support frame of one of the support assemblies in a forward and rearward slidable way. The drawer assembly is configured as: when the drawer is moved rearward to approach to the rear extreme position, a rear end of the drawer pushes rearward the elastic tongue, so that the elastic tongue generates elastic deformation, thus allowing the elastic tongue to apply a forward elastic cushioning force to the drawer.

Optionally, the elastic tongue extends forward and rearward. Additionally, a rear portion of the elastic tongue is fixed to the support frame. A front portion gradually slopes upward and tilts from the rear side to the front side. When the drawer is moved rearward to approach to the rear extreme position, the rear end of the drawer is in contact with a lower surface of the front portion of the elastic tongue so as to push rearward the elastic tongue, so that the front portion of the elastic tongue bends upward to apply the elastic cushioning force to the drawer.

Optionally, the rear portion of the elastic tongue extends along a horizontal plane. An included angle between the front portion and the horizontal plane is in a range of 5° to 10°.

Optionally, a first pulley is respectively mounted at a rear end of the left sidewall and the right sidewall of the drawer. When the drawer is moved forward and rearward, the first pulley rolls on an upper surface of the first slideway. Additionally, when the drawer is moved rearward to approach to the rear extreme position, the first pulley is in contact with the lower surface of the front portion of the elastic tongue so as to push rearward the elastic tongue.

Optionally, the left sidewall and the right sidewall of the drawer are respectively provided with a second slideway extending forward and rearward. A front end of the inner side of the support frame is provided with a second pulley. When the drawer is moved forward and rearward, the second pulley rolls along a lower surface of the second slideway so as to support the second slideway.

Optionally, a stop block is fixed to a rear end of the inner side of the support frame. When the drawer is moved rearward to the rearward extreme position, a rear end of the second slideway collides with the stop block, so that the drawer is incapable of being continuously moved rearward.

Optionally, the left sidewall and the right sidewall of the drawer are respectively provided with an upper guide strip and a lower guide strip located below the upper guide strip. The upper guide strip and the lower guide strip are both provided with a bottom edge gradually sloping downward from the rear side to the front side. An upper slide groove and a lower slide groove are formed in the support frame. The upper slide groove extends forward and rearward. The lower slide groove is provided with a front vertical section, a horizontal section extending rearward from a bottom end of the front vertical section, and a rear vertical section extending downward from a rear end of the horizontal section. Additionally, the support assembly further includes: a connecting member and an elastic element. Front and rear ends of the connecting member are respectively provided with a front guide post and a rear guide post with axes extending leftward and rightward. The front guide post extends into the lower slide groove. The rear guide post extends into the upper slide groove. The elastic element applies a rearward elastic pre-tightening force to the connecting member. The drawer assembly is configured as: when the drawer is in a normal open state, the front guide post is clamped in the front vertical section, the upper guide strip and the lower guide strip are located in front of the front guide post; in a process of moving rearward the drawer, the upper guide strip is moved rearward, and at the same time, the bottom edge of the upper guide strip presses downward the front guide post, so that the front guide post leaves away from the front vertical section to enter the horizontal section and is abutted against a front edge of the lower guide strip, thus pushing the drawer to move rearward in an accelerated way under the effect of the elastic pre-tightening force; in a process of moving forward and opening the drawer, the lower guide strip pushes forward the front guide post, so that the front guide post is clamped in the front vertical section again, and the drawer is continuously moved forward; and additionally, when the drawer is in an abnormal open state that the front guide post is clamped at the rear end of the horizontal section, the drawer is moved rearward, the lower guide strip is moved rearward, and at the same time, the bottom edge of the lower guide strip presses downward the front guide post, so that the front guide post enters the rear vertical section so as to allow the lower guide strip to cross the front guide post, and the front guide post is located in front of the lower guide strip again.

Optionally, the drawer assembly is further configured as: in the process of moving rearward the drawer, when the front guide post leaves away from the front vertical section, a front end of the lower guide strip is located at a preset distance in front of the front guide post, so that after leaving away from the front vertical section, the front guide post is moved rearward under the effect of the elastic pre-tightening force to collide with the lower guide strip, and a prompt sound of drawer closing is given out.

Optionally, the support frame is provided with an inner layer plate and an outer layer plate extending forward and rearward and parallel to each other. The upper slide groove is respectively formed in the inner layer plate and the outer layer plate. The lower slide groove is formed in the inner layer plate. The connecting member is located between the inner layer plate and the outer layer plate. The rear end of the connecting member is provided with two of the rear guide posts extending leftward and rightward. The two rear guide posts respectively enter one of the upper slide grooves. The front end of the connecting member is provided with one of the front guide posts extending toward the drawer.

In another aspect, the present invention provides a refrigerator, including a refrigerator body defining a storage component, and at least one drawer assembly according to any one of the above. The support frame of the support assembly is fixed to the inner wall of the storage compartment. The left sidewall and the right sidewall of the drawer are respectively mounted on the first sideway of the support frame of one of the support assemblies in a forward and rearward translatable way.

According to the refrigerator and the drawer assembly thereof of the present invention, each drawer is mounted on the two support frames in a forward and rearward translatable way. When the drawer is moved rearward to approach to the rear extreme position, the elastic tongue at the rear portion of the support frame will be pushed, so that the elastic tongue generates elastic deformation so as to apply the forward elastic cushioning force to the drawer. Therefore, the rearward movement of the drawer is cushioned, and the drawer will be stably closed without seriously colliding with other components of the refrigerator. Generation of great noise is avoided. The service life of the drawer assembly is prolonged. Damage cannot be caused on food in the drawer.

Further, the refrigerator and the refrigerator assembly thereof of the present invention realize the power-assisted automatic closing of the drawer by using the two support assemblies, are simple in structure, and are not easy to break down. Additionally, when the drawer is in the abnormal open state that the front guide post is clamped at the rear end of the horizontal section, the user only needs to move rearward the drawer to allow the front guide post to be back to the front of the lower guide strip again, so that the mechanism returns to normal, professional repair is not needed, and the use is very convenient and fast.

Further, according to the refrigerator and the refrigerator assembly thereof of the present invention, when the drawer is closed, and after leaving away from the front vertical section, the front guide post can be moved forward under the effect of the elastic pre-tightening force to collide with the lower guide strip, so as to give out the prompt sound. After hearing the prompt sound, the user loosens the grip, so that the subsequent closing process of the drawer can be completed automatically. The user experience is very good.

The above and other objectives, advantages and features of the present invention will become more apparent to those skilled in the art from the following detailed description of specific embodiments of the present invention in conjunction with the accompanying drawings.

BRIEF DESCRIPTION OF THE DRAWINGS

Some specific embodiments of the present invention will be described in detail hereinafter in way of example and not by way of limitation with reference to the accompanying drawings. The same reference numerals in the drawings indicate the same or similar components or parts. It should be understood by those skilled in the art that these drawings are not necessarily drawn to scale. In the drawings.

DETAILED DESCRIPTION

Figure 1:
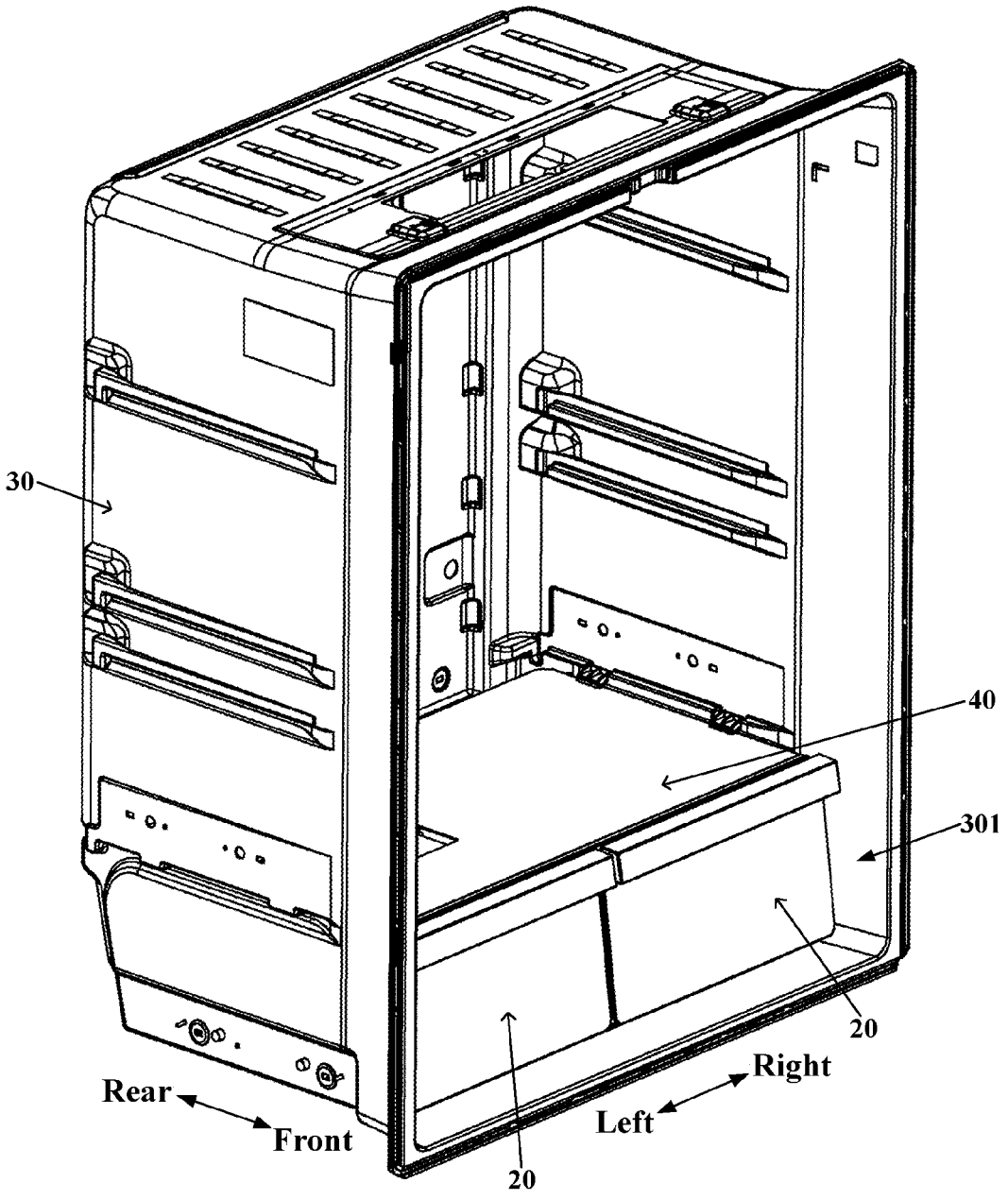
FIG. 1 is a schematic assembly diagram of a refrigerator body and a drawer assembly of a refrigerator according to an embodiment of the present invention.

An embodiment of the present invention provides a refrigerator and a drawer assembly thereof. FIG. 1 shows a partial structure of the refrigerator, and only shows a storage compartment and an internal structure thereof.

As shown in FIG. 1 to FIG. 4, the refrigerator includes a refrigerator body 30. The refrigerator body 30 defines the storage compartment with an open front side, so as to store articles. Front and rear directions have been shown in the figure. At least one drawer assembly is arranged in the storage compartment. Each drawer assembly includes drawers 20 arranged in the storage compartment in a way of being capable of being pushed and pulled forward and rearward between a front extreme position (a position where the drawer cannot be continuously moved forward through forward pulling) and a rear extreme position (a position where the drawer cannot be continuously moved rearward through rearward pushing), and two support assemblies 10 in left-right parallel arrangement. Each of the support assemblies 10 includes a support frame 100. The support frame 100 is fixed to an inner wall of the storage compartment, and is provided on an inner side with a first slideway 110 extending forward and rearward. A left sidewall 21 and a right sidewall 22 of the drawer 20 are respectively mounted on the first sideway 110 of the support frame 100 of one of the support assemblies 10 in a forward and rearward translatable way.

In some embodiments, the plurality of drawer assemblies may be arranged. For example, as shown in FIG. 1 to FIG. 4, the number of the drawer assemblies is two. Additionally, the two drawer assemblies are in left-right parallel arrangement, so as to facilitate classified storage of the articles. For example, an internal space of one drawer may be made into a dry storage area, and an internal space of the other drawer is made into a moist storage area.

Figure 2:
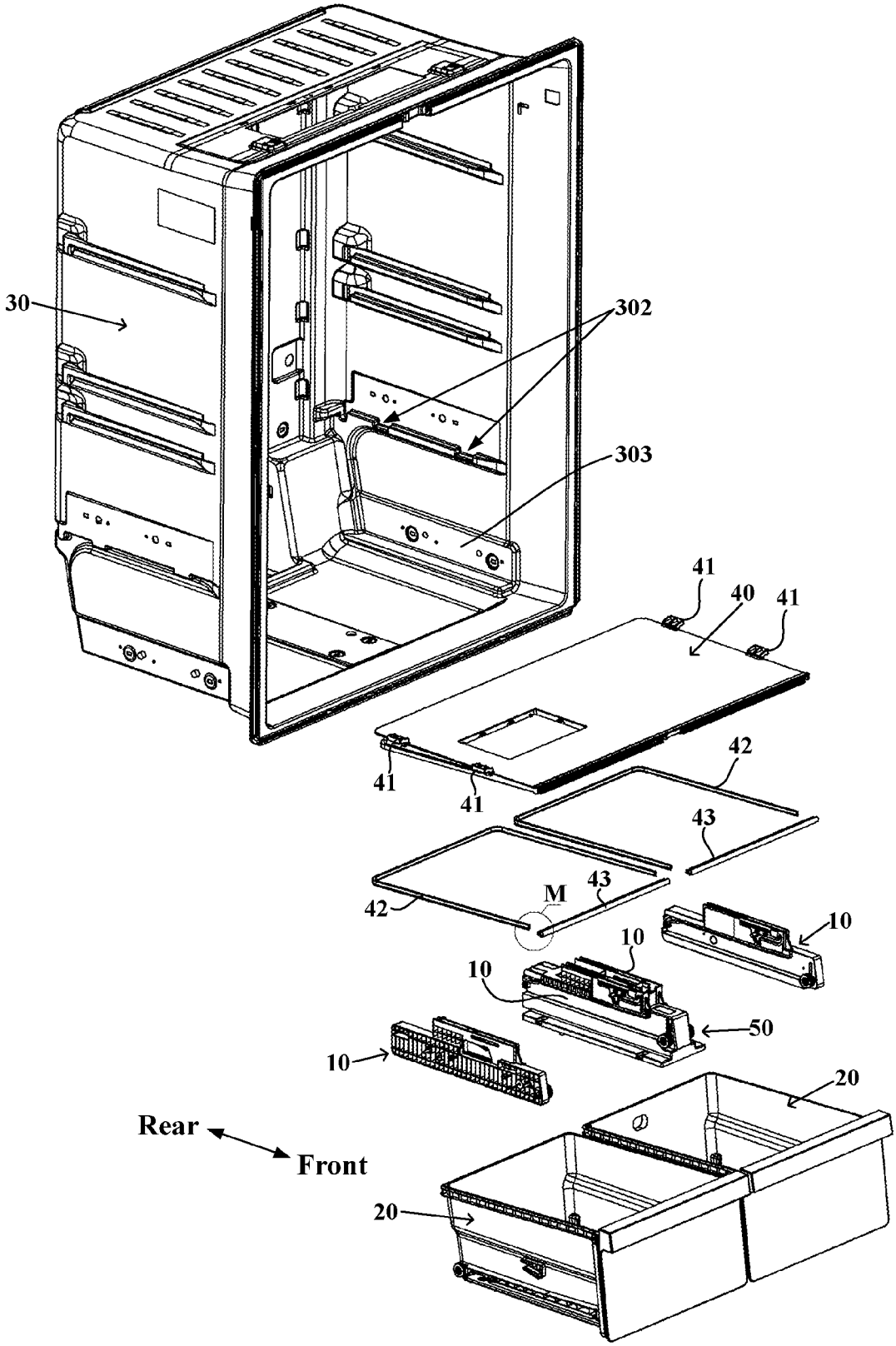
FIG. 2 is a schematic exploded view of a structure shown in FIG. 1.
Figure 3:
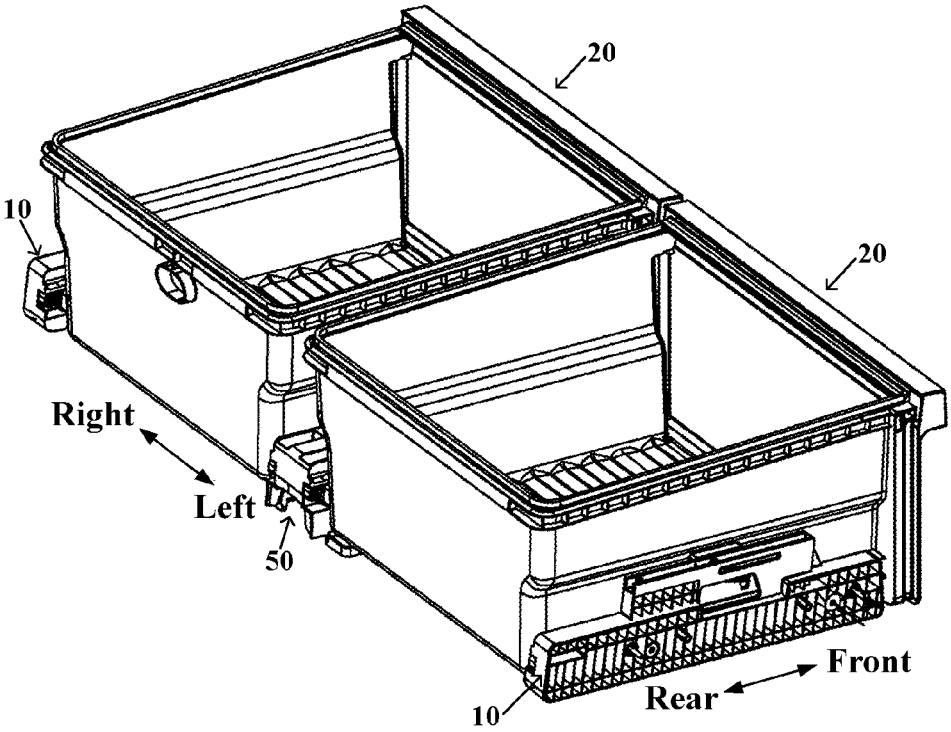
FIG. 3 is a schematic structure diagram of two drawers and support assemblies thereof in FIG. 1.
Figure 9:
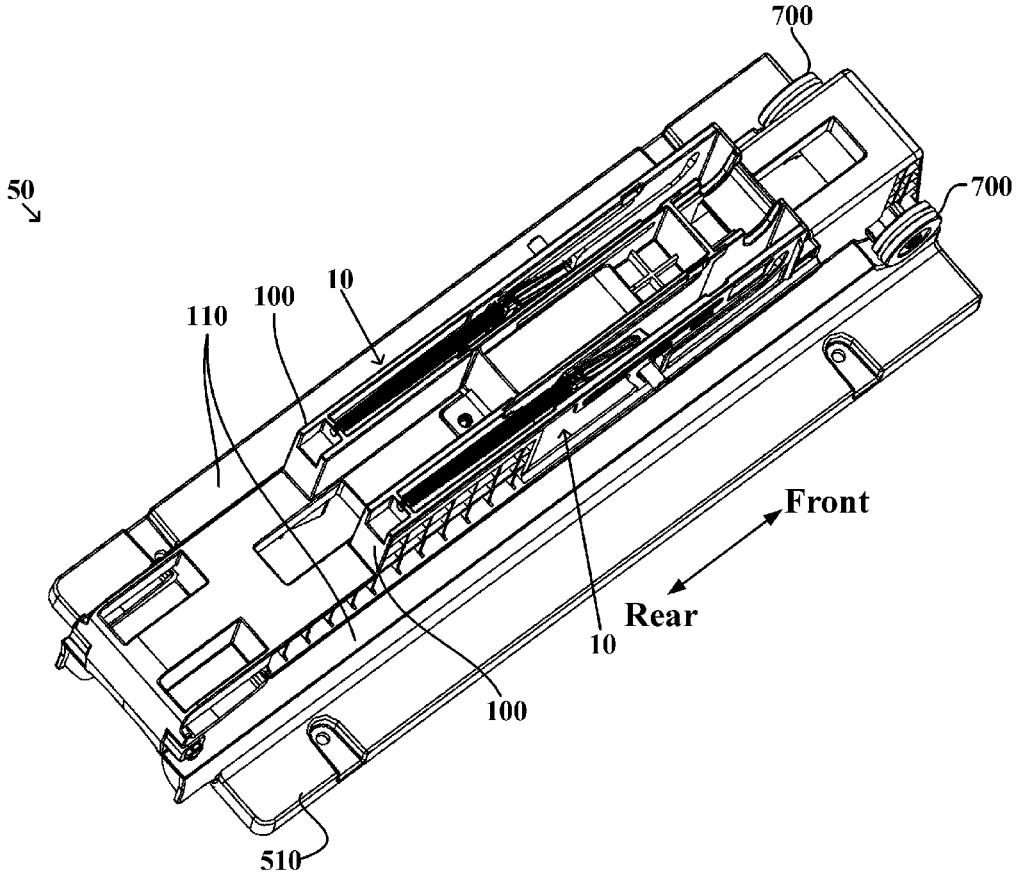
FIG. 9 is a schematic structure diagram of a middle support assembly.
Figure 10:
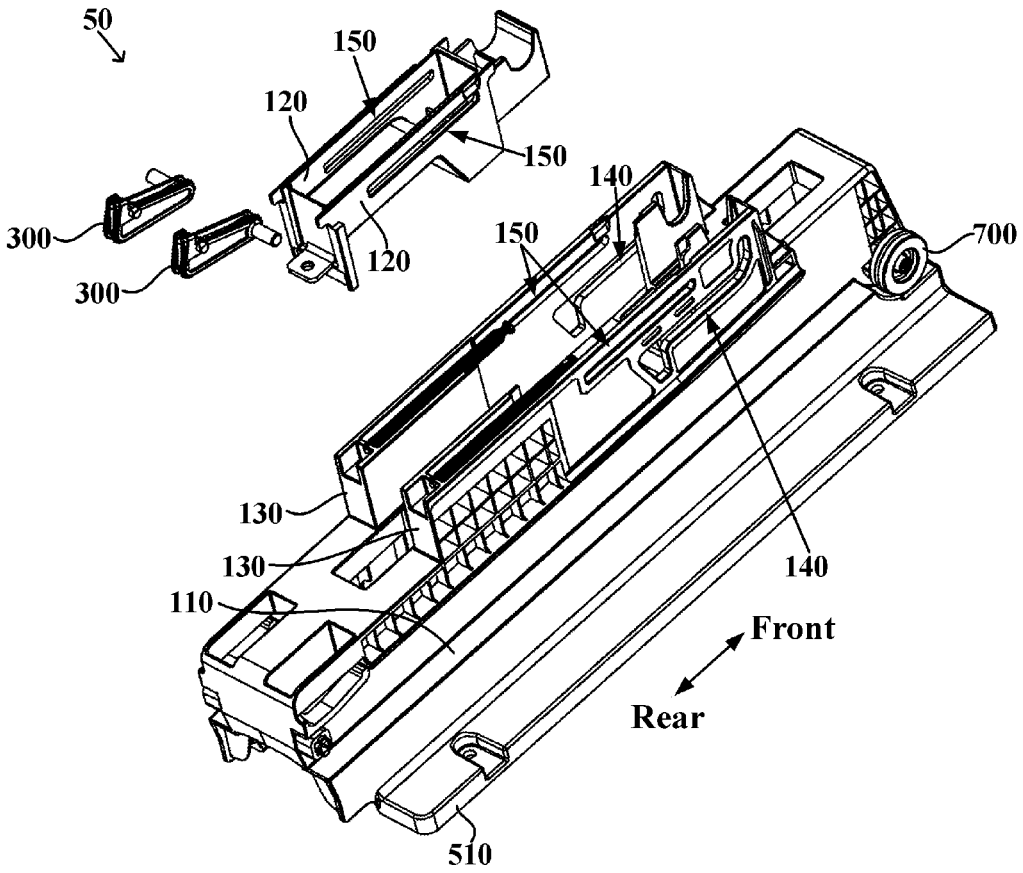
FIG. 10 is a schematic exploded view of the middle support assembly.

As shown in FIG. 2, FIG. 9 and FIG. 10, one support assembly 10 is arranged on the left side of the drawer assembly on the left side. One support assembly 10 is arranged on the right side of the drawer assembly on the right side. The support frame 100 of the right support assembly 10 of the drawer assembly located on the left side and the support frame 100 of the left support assembly 10 of the drawer assembly located on the right side are formed on a support frame base 510, so as to form an integral middle support assembly 50. The support frame base 510 is fixedly mounted on a bottom wall of the storage compartment.

Figure 4:
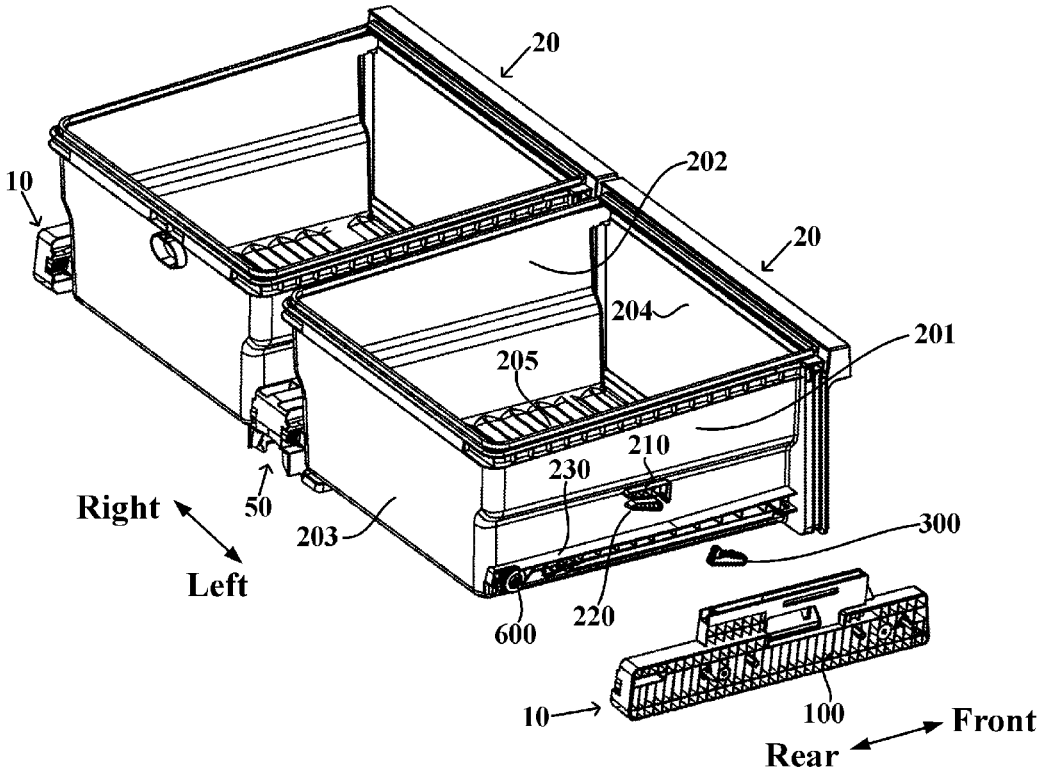
FIG. 4 is a schematic exploded view of a structure shown in FIG. 3.
Figure 5:
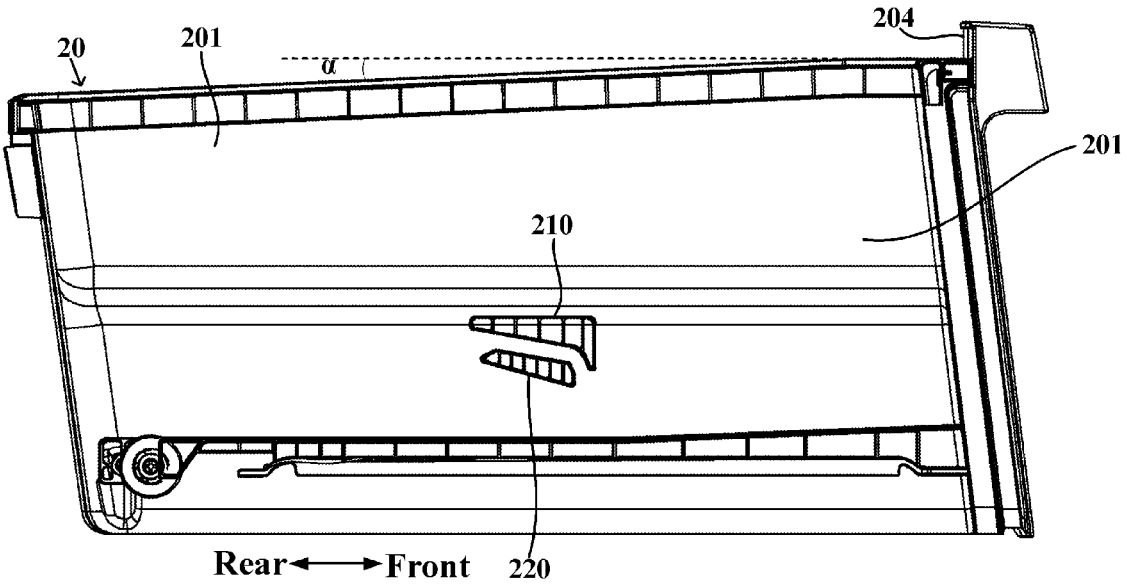
FIG. 5 is a schematic left view of the drawer.

In some embodiments, as shown in FIG. 2, FIG. 4 and FIG. 5, the drawer 20 is provided with a bottom wall 205, and a rear sidewall 203, a left sidewall 201, a right sidewall 202 and a front end wall 204 respectively extending upward from four edges of the bottom wall 205, so as to jointly define an accommodating space with an upper side opening. A top edge of the front end wall 204 is higher than the left sidewall 201 and the right sidewall 202 (as shown in FIG. 5), so as to favorably seal the front side opening of the storage compartment by the front end wall 204. An upper cover plate 40 is further arranged in the storage compartment. The upper cover plate 40 is fixed to the inner wall of the storage compartment, and is configured to seal and cover the upper side opening of the drawer 20 when the drawer 20 is located in the rear extreme position. An upper surface of the upper cover plate may also be configured to store articles. As shown in FIG. 2, two mounting bulges 41 are respectively arranged on the left side and the right side of the upper cover plate 40. Two mounting recesses 302 are respectively formed in the left sidewall and the right sidewall of the storage compartment. Each mounting bulge 41 is embedded in one mounting recess 302, so as to realize fixation of the upper cover plate 40. When the drawer 20 is in the rear extreme position, a sealing assembly is configured to seal a gap between the drawer 20 and the upper cover plate 40, so that an independent and sealed storage space is formed inside the drawer 20.

Figure 20:
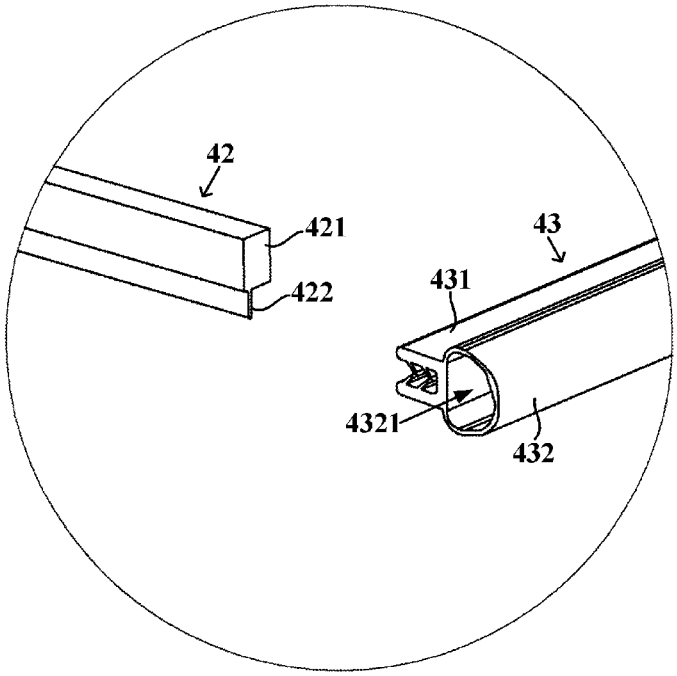
FIG. 20 is an enlarged view of a position M in FIG. 2.
Figure 21:
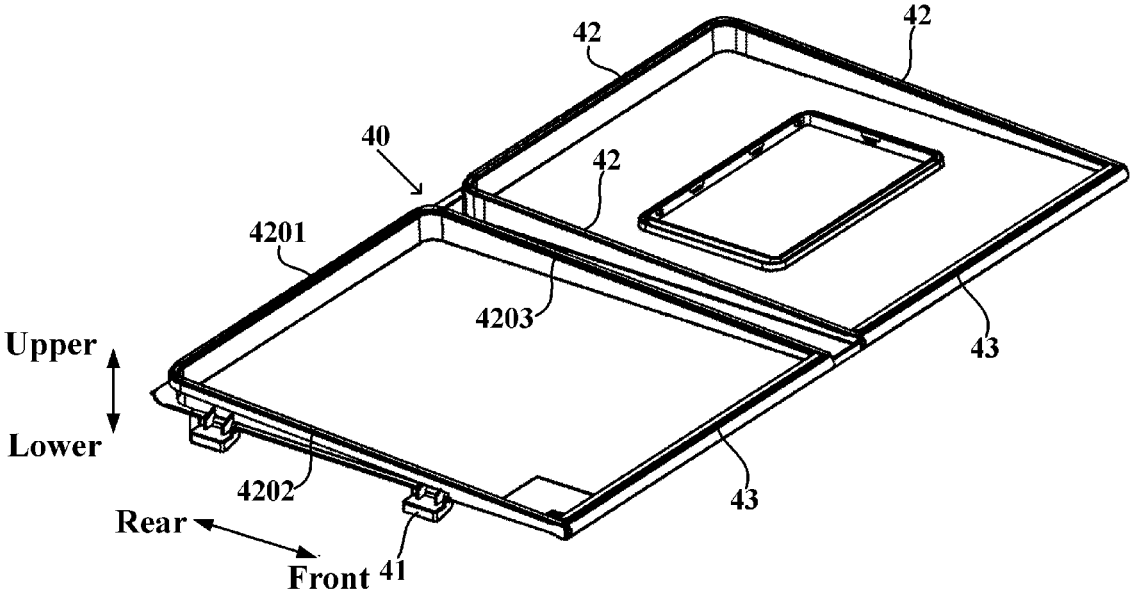
FIG. 21 is a schematic structure diagram of a bottom of an upper cover plate.

As shown in FIG. 2, FIG. 20 and FIG. 21, the sealing assembly includes a front sealing strip 43 and a rear sealing strip 42. The front sealing strip 43 is mounted on the front edge of the upper cover plate 40 in a way of extending leftward and rightward. When the drawer 20 is in the rear extreme position, the front sealing strip 43 is abutted against the rear surface of the front end wall 204 in a sealed way.

Specifically, as shown in FIG. 20, the front sealing strip 43 may include a front sealing strip substrate 431 and a sealing portion 432. The front sealing strip substrate 431 extends leftward and rightward for connection (such as bonding or clamp connection) with the upper cover plate 40. The sealing portion 432 is connected to the front side of the front sealing strip substrate 431, and is in a hollow tubular shape, and a cavity 4321 is formed inside it. The sealing portion 432 is configured to be in contact with the rear surface of the front end wall 204, and is extruded rearward by the rear surface of the front end wall 204 to generate elastic deformation, thus facilitating sealing.

The rear sealing strip 42 is mounted on the lower surface of the upper cover plate 40, and includes a rear sealing section 4201 extending leftward and rightward, and a left sealing section 4203 and a right sealing section 4202 bending forward from the left and right ends of the rear sealing section 4201. When the drawer 20 is in the rear extreme position, the rear sealing section 4201 is abutted against the top edge of the rear sidewall 203 in a sealed way. The left sealing section 4203 is abutted against the top edge of the left sidewall 201 in a sealed way. The right sealing section 4202 is abutted against the top edge of the right sidewall 202 in a sealed way.

Specifically, from a sectional view of the rear sealing strip shown in FIG. 20, the rear sealing strip 42 may include a rear sealing strip substrate 421 and a sealing sheet 422. The rear sealing strip substrate 421 is configured for connection (such as bonding or clamp connection) with the upper cover plate 40. The sealing sheet 422 downward extends out from the lower surface of the rear sealing strip substrate 421, and generates elastic deformation when being in contact with the top edge of the rear sidewall 203, the left sidewall 201 or the right sidewall 202 of the drawer 20, thus facilitating sealing. The thickness of the sealing sheet 422 is thinner (may be less than 5 mm), thus facilitating its deformation. For example, for the left sealing section 4202, the sealing sheet 422 is extruded by the top edge of the left sidewall 201 to bend leftward or rightward, so as to be tightly attached to the top edge of the left sidewall 201.

In some structures, as shown in FIG. 5 and FIG. 21, preferably, the top edges of the left sidewall 201 and the right sidewall 201 gradually slope downward at a preset angle $\alpha$ (referring to FIG. 5) from the front side to the rear side respectively. Correspondingly, the left sealing section 4203 and the right sealing section 4202 of the rear sealing strip 42 gradually slope downward from the front side to the rear side. Only when the drawer 20 is moved rearward to be about to be closed, the top edges of the left sidewall 201 and the right sidewall 202 can be in contact with the left sealing section 4203 and the right sealing section 4202, so that greater friction is avoided, and the drawer is moved rearward with less effort. At the same time, through such a design, it is convenient for the drawer to tightly press rearward the rear sealing strip, and a better sealing effect is achieved.

In some of the existing sealing structures, the above front sealing strip and rear sealing strip may be manufactured into an integral quadrangular structure. However, when the drawer using such a structure is moved rearward, the left/right sealing section and the front sealing strip are subject to a rearward friction force of the drawer, and displacement and deformation are easily generated due to the interaction, so that the sealing performance is influenced, and a greater friction resistance may also be brought to the drawer. In the present embodiment, the sealing assembly is divided into two portions: the front sealing strip 43 and the rear sealing strip 42. The front sealing strip 43 is configured to be abutted against the front end wall 204 of the drawer 20 in a sealed way, and cannot bring a friction resistance to the drawer 20 in the process of moving rearward the drawer 20. No fixed connection relationship exists among the left sealing section 4203 and right sealing section 4202 of the rear sealing strip 42 and the front sealing strip 43. In the process of moving rearward the drawer 20, even if being pushed rearward by the top of the drawer 20, the left sealing section 4203 and the right sealing section 4202 cannot apply any acting force to the left and right ends of the front sealing strip 43, so that the left and right ends of the front sealing strip 43 can be prevented from being deformed and displaced to influence the sealing or bring the greater friction resistance to the rearward movement of the drawer.

As shown in FIG. 2, two drawer assemblies may be arranged in the storage compartment. The upper cover plate 40 is configured to seal and cover the upper side openings of the drawers 20 of the two drawer assemblies. Additionally, the number of the sealing assemblies is also two. The two sealing assemblies are in left-right parallel arrangement on the upper cover plate 40, so as to be respectively matched with the drawers of the two drawer assemblies.

Figure 6:
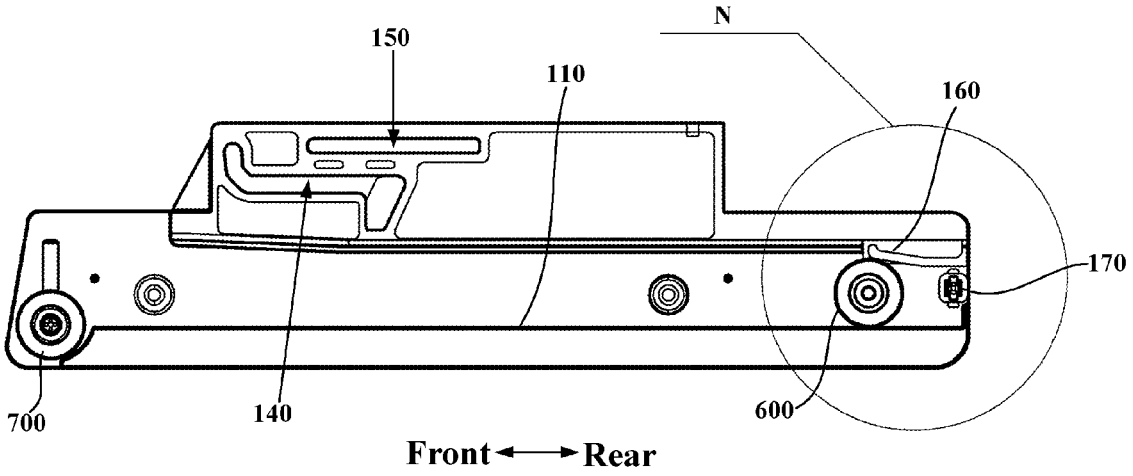
FIG. 6 is a schematic structure diagram of an inner side of a support frame.
Figure 7:
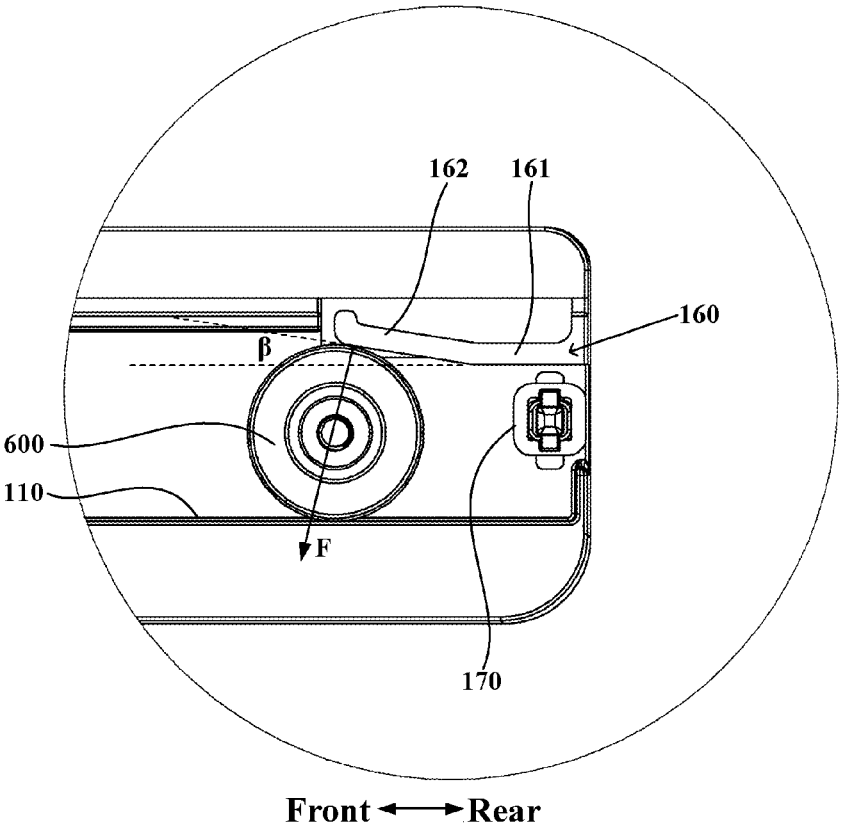
FIG. 7 is an enlarged view of a position N in FIG. 6.

In some embodiments, as shown in FIG. 6 and FIG. 7, the support frame 100 is provided on the rear portion of the inner side with an elastic tongue 160. The drawer assembly is configured as: when the drawer 20 is moved rearward to approach to the rear extreme position, the rear end of the drawer pushes rearward the elastic tongue 160, so that the elastic tongue generates elastic deformation, thus allowing the elastic tongue 160 to apply a forward elastic cushioning force to the drawer 20. Therefore, the rearward movement of the drawer 20 is cushioned, and the drawer will be stably closed without seriously colliding with other components of the refrigerator. Generation of greater noise is avoided. The service life of the drawer assembly is further prolonged. Damage cannot be caused on food in the drawer.

For example, the elastic tongue 160 may extend forward and rearward. Additionally, a rear portion 161 of the elastic tongue is fixed to the support frame 100. A front portion 162 gradually slopes upward and tilts from the rear side to the front side. The elastic tongue 160 may be made of materials such as PS or polystyrene. As shown in FIG. 7, the rear portion 161 of the elastic tongue 160 may extend along a horizontal plane. An include angle between the front portion 162 and the horizontal plane is β. β is preferably in a range of 5 to 10°, so that the elasticity is limited in a range of 5 to 7 N. A cushioning effect can be achieved. An excessive resistance cannot be brought to closing of the drawer 20. When the drawer 20 is moved rearward to approach to the rear extreme position, the rear end of the drawer is in contact with the lower surface of the front portion of the elastic tongue 160 so as to push rearward the elastic tongue 160, so that the front portion of the elastic tongue 160 bends upward to apply the elastic cushioning force to the drawer 20. In some embodiments, a first pulley 600 is respectively mounted at the rear end of the left sidewall 201 and the right sidewall 202 of the drawer 20. When the drawer 20 is moved forward and rearward, the first pulley 600 rolls on the upper surface of the first slideway 110. When the drawer 20 is moved rearward to approach to the rear extreme position, the first pulley 600 is in contact with the lower surface of the front portion 162 of the elastic tongue 160 so as to push rearward the elastic tongue 160. Specifically, as shown in FIG. 7, the elastic tongue 160 applies an acting force F passing through the circle center of the first pulley and deviating toward the lower side to the first pulley 600. A vertically downward component force of the acting force F is offset by the slideway 110. A rearward component force of the acting force F is configured to cushion the rearward movement of the drawer.

Figure 19:
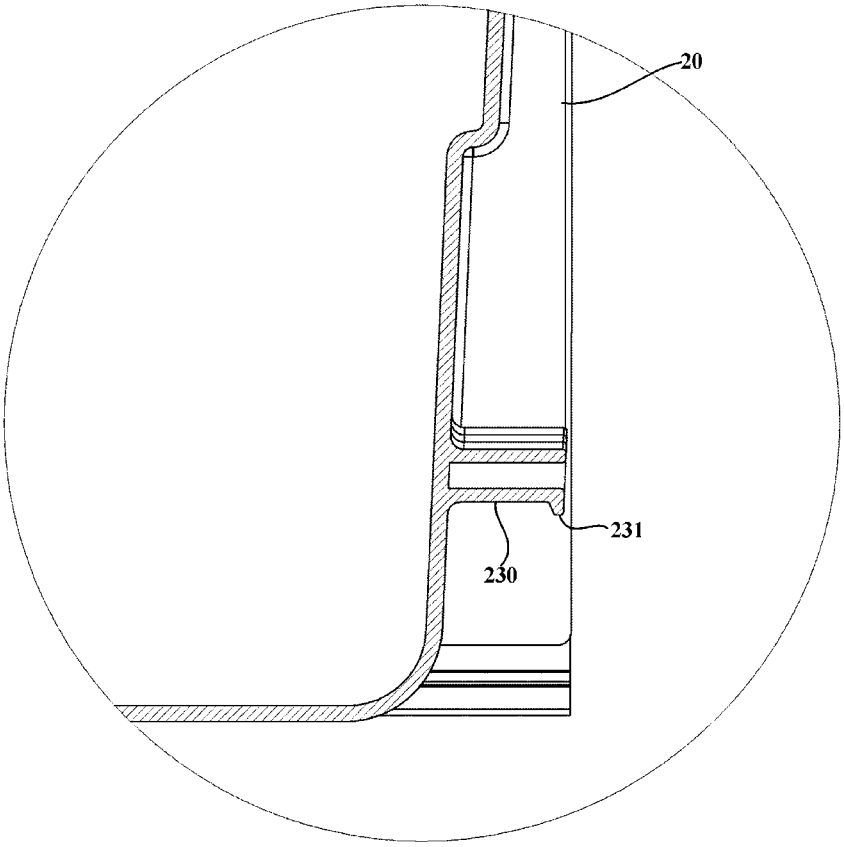
FIG. 19 is a schematic sectional view of a local structure of the drawer at a second slideway.

The left sidewall 201 and the right sidewall 202 of the drawer 20 are respectively provided with a second slideway 230 extending forward and rearward, and the front end of the inner side of the support frame 100 is provided with a second pulley 700. When the drawer is moved forward and rearward, the second pulley 700 rolls along the lower surface of the second slideway 230 so as to support the second slideway 230. Further, as shown in FIG. 19, the bottom surface of the second slideway 230 may also be provided with a flange 231 extending forward and rearward. The second pulley 700 is located on the inner side of the flange 231, so that the second pulley 700 cannot leave away from the second pulley 230 due to leftward and rightward movement. Through the two pulleys and the two slideways, the drawers 20 are stably supported on the two support frames 100. Additionally, the drawers can be pushed forward and rearward with less effort.

In some alternative embodiments, sliding friction connection may also be adopted between the slideway of the drawer 20 and the slideway of the support frame 100 so as to omit the pulleys, or the two pulleys may be both arranged on the drawer 20, or the two pulleys are both arranged on the support frame 100. The specific structure is omitted herein.

As shown in FIG. 6, a stop block 170 is fixed to the rear end of the inner side (the side near the drawer) of the support frame of the support assembly, and may be made of rubber materials. When the drawer 20 is moved rearward to the rearward extreme position, the rear end of the drawer collides with the stop block 170, so that the drawer 20 is incapable of being continuously moved rearward, and the maximum rearward movement position of the drawer 20 is defined.

A preferable structure form of the support assembly is illustrated hereafter through FIG. 4 to FIG. 19. As shown in FIG. 4 and FIG. 5, the left sidewall 201 and the right sidewall 202 of the drawer 20 are respectively provided with an upper guide strip 210 and a lower guide strip 220. The lower guide strip 220 is located below the upper guide strip 210. The upper guide strip 210 and the lower guide strip 220 are both provided with a bottom edge gradually sloping downward from the rear side to the front side.

Figure 8:
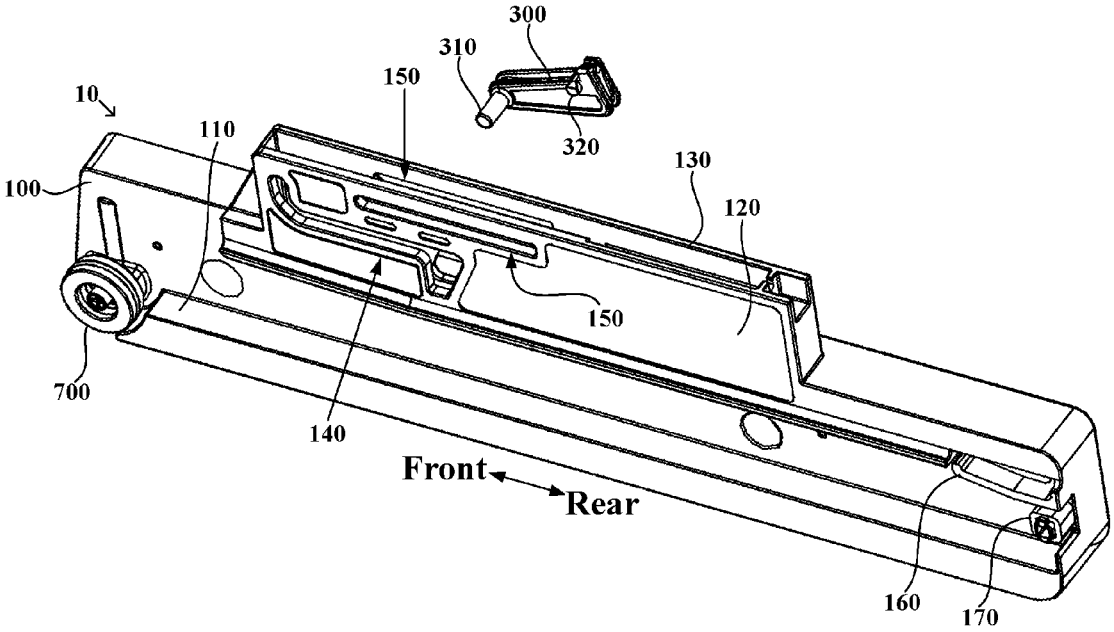
FIG. 8 is a schematic exploded view of the support assembly.

Each support assembly 10 includes a support frame 100, connecting members 300 and elastic elements. FIG. 6 and FIG. 8 show the support assembly 10 located on the left side of the drawer 20. FIG. 9 and FIG. 10 show the middle support assembly 50. In FIG. 11 to FIG. 18, the upper guide strip 210 and the lower guide strip 220 are both represented by dotted lines.

An upper slide groove 150 and a lower slide groove 140 are formed in the support frame 100. The upper slide groove 150 extends forward and rearward. The lower slide groove 140 is of a three-section structure, and includes a front vertical section 141, a horizontal section 142 extending rearward from the bottom end of the front vertical section 141, and a rear vertical section 143 extending downward from the rear end of the horizontal section 142. Smooth transition is preferably adopted between the front vertical section 141 and the horizontal section 142.

The front and rear ends of the connecting member 300 are respectively provided with a front guide post 310 and a rear guide post 320 with axes extending leftward and rightward. The front guide post 310 extends into the lower slide groove 140, and can slide in the extending direction of the lower slide groove 140. The rear guide post 320 extends into the upper slide groove 150, and can slide in the extending direction of the upper slide groove 150. It could be understood that because the shape of the lower slide groove 140 is irregular, when the connecting member 300 slides forward and rearward, rotation taking the axis of the rear guide post 320 as an axis will further be generated.

The elastic element is configured to apply a rearward elastic pre-tightening force to the connecting member 300. The elastic element may be specifically a tension spring 500. The front end of the tension spring 500 is fixed to the rear portion of the connecting member 300. The rear end is fixed to the support frame 100.

Figure 11:
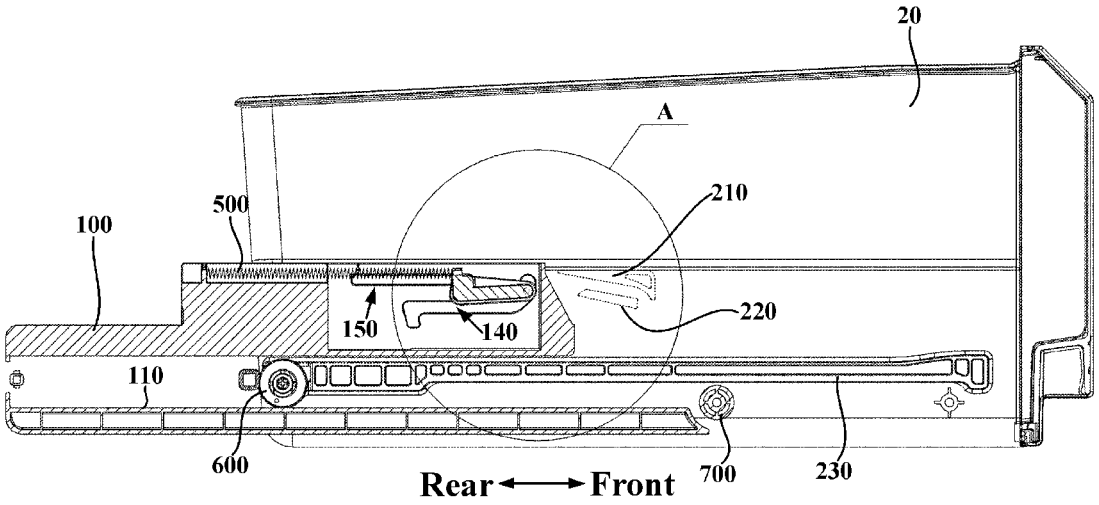
FIG. 11 is a sectional view of the drawer assembly when the drawer is in a normal open state.
Figure 12:
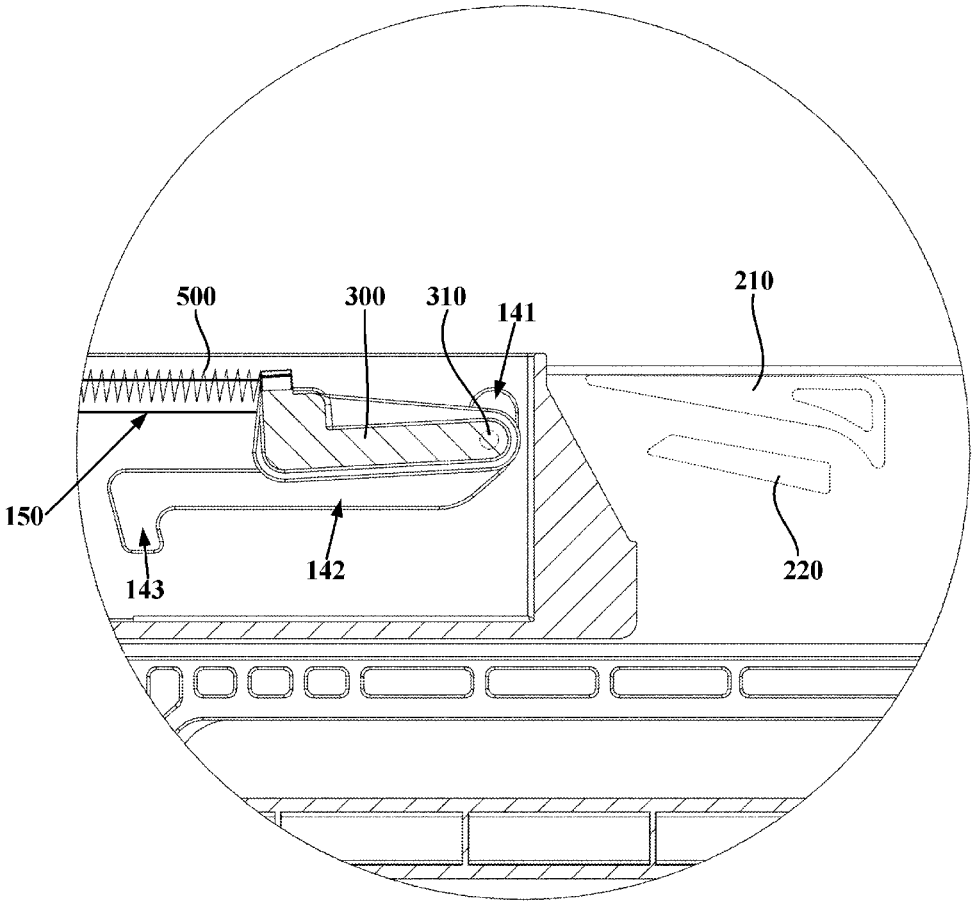
FIG. 12 is an enlarged view of a position A in FIG. 11.

The processes of opening and closing the drawer 20 will be described hereafter:

(1) The drawer 20 is in a normal open state, as shown in FIG. 11 and FIG. 12. At this time, the connecting members 300 are subject to the rearward elastic pre-tightening force, so that the front guide post 310 is clamped in the front vertical section 141. The upper guide strip 210 and the lower guide strip 220 are located in front of the front guide post 310.

(2) The process of closing the drawer 20, i.e., the process shown in FIG. 11 and FIG. 12 to FIG. 13 and FIG. 14, is shown. In this process, the user firstly pushes rearward the drawer 20, the upper guide strip 210 is moved rearward accordingly, and the bottom edge of the upper guide strip will be in contact with the front guide post 310. The bottom edge of the upper guide strip 210 extends slantways, so that it presses downward the front guide post 310 in a rearward movement process, and the front guide post 310 is moved downward in the front vertical section 141 until leaving away from the front vertical section 141 to enter the horizontal section 142. The front guide post 310 will be moved rearward under the effect of the elastic pre-tightening force while entering the horizontal section 142, so as to be just abutted against the front edge of the lower guide strip 220. Then, the lower guide strip 220 is pushed to move rearward in an accelerated way under the effect of the pre-tightening force along the horizontal section 142, i.e., the drawer 20 is pushed to move rearward in an accelerated way until the drawer 20 is completely closed. At this time, the front guide post 310 is just located at the rear end of the horizontal section 142.

Preferably, in the process of moving rearward and closing the drawer 20, when the front guide post 310 leaves away from the front vertical section 141, the front end of the lower guide strip 220 is located at a preset distance (such as 1 to 3 cm) in front of the front guide post 310 (instead of being just in contact with the lower guide strip 220), so that after leaving away from the front vertical section 141, the front guide post 310 is moved rearward in an accelerated way under the effect of the elastic pre-tightening force to collide with the lower guide strip 220, and a prompt sound is given out to prompt the user to close the drawer. The user can loosen the grip after hearing the prompt sound, so that the drawer 20 is automatically closed, and the user experience is very good.

(3) The process of normally opening the drawer 20, i.e., the process in FIG. 13 and FIG. 14 to FIG. 11 and FIG. 12, is shown. In this process, the user pulls forward the drawer 20, and the lower guide strip 220 overcomes the elastic pre-tightening force to push the front guide post 310 to move forward along the horizontal section 142. When the frontmost end of the horizontal section 142 is reached, the front guide post 310 is gradually moved upward along a junction of the horizontal section 142 and the front vertical section 141 to enter the front vertical section 141, so as to be clamped in the front vertical section 141 again. At this time, the front guide post 310 has leaved away from the lower guide strip 220, and the drawer 20 can be continuously moved forward to be opened to a degree required by the user.

Figure 13:
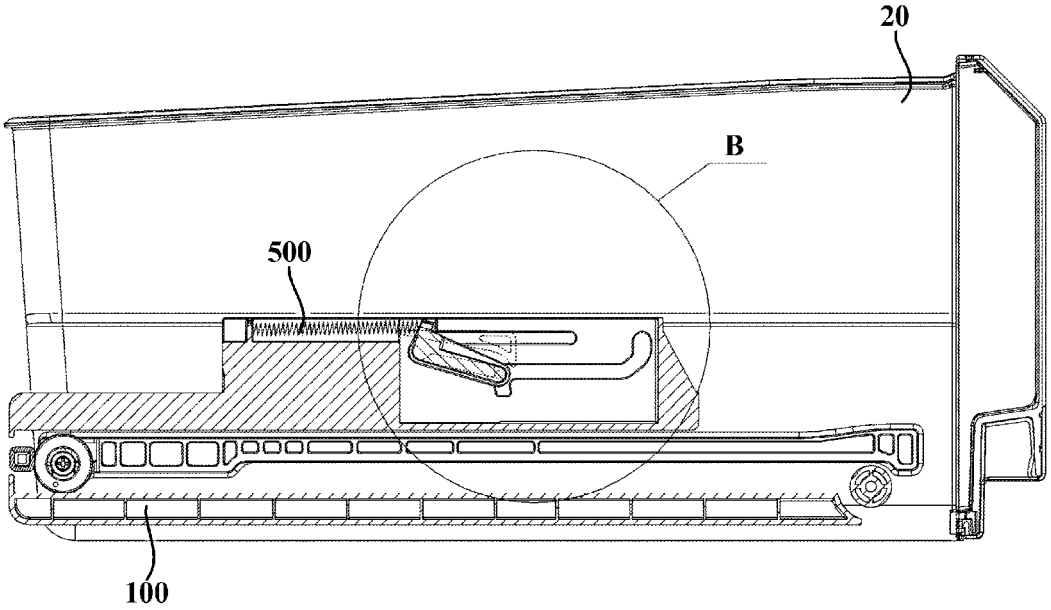
FIG. 13 is a sectional view of the drawer assembly when the drawer is in a closed state.
Figure 14:
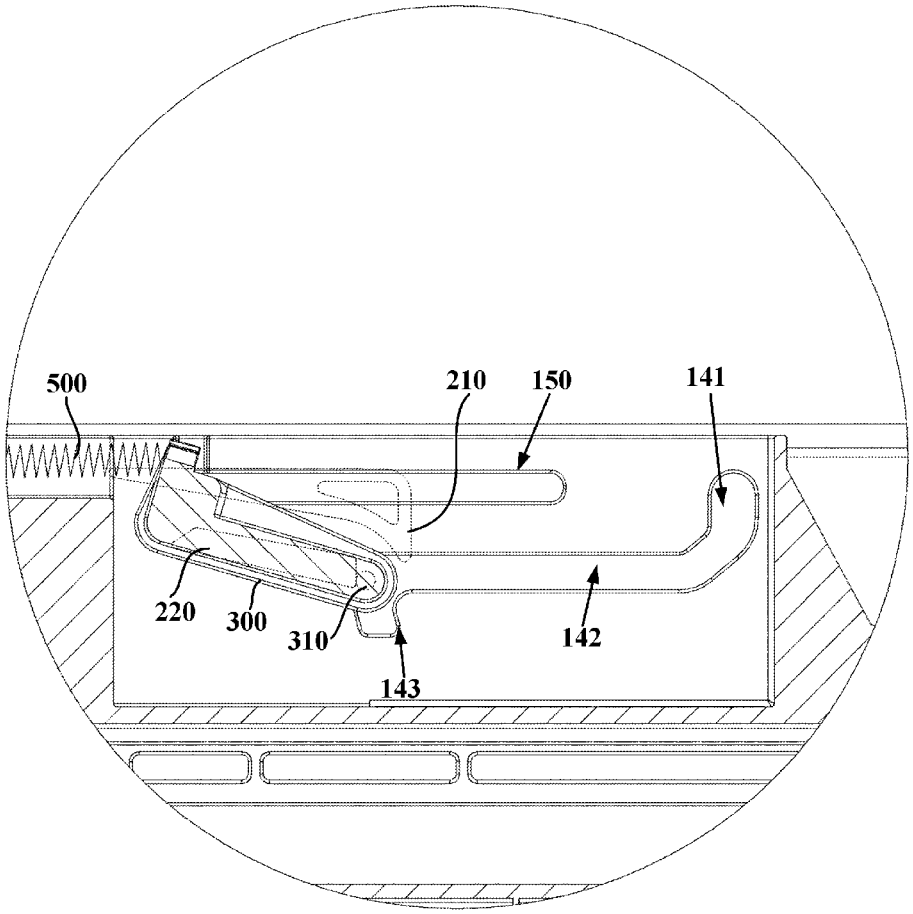
FIG. 14 is an enlarged view of a position B in FIG. 13.
Figure 15:
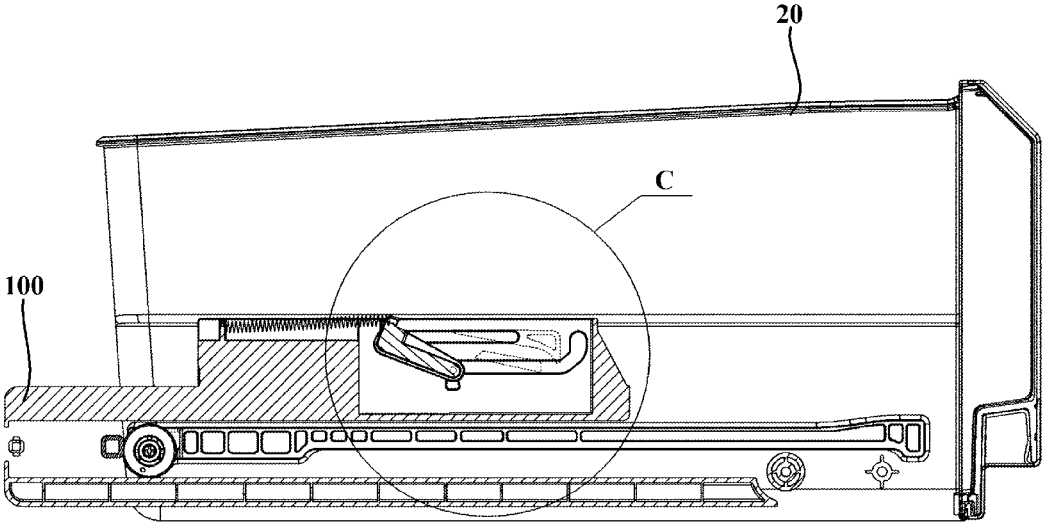
FIG. 15 is a sectional view of the drawer assembly when the drawer is in an abnormal open state.
Figure 16:
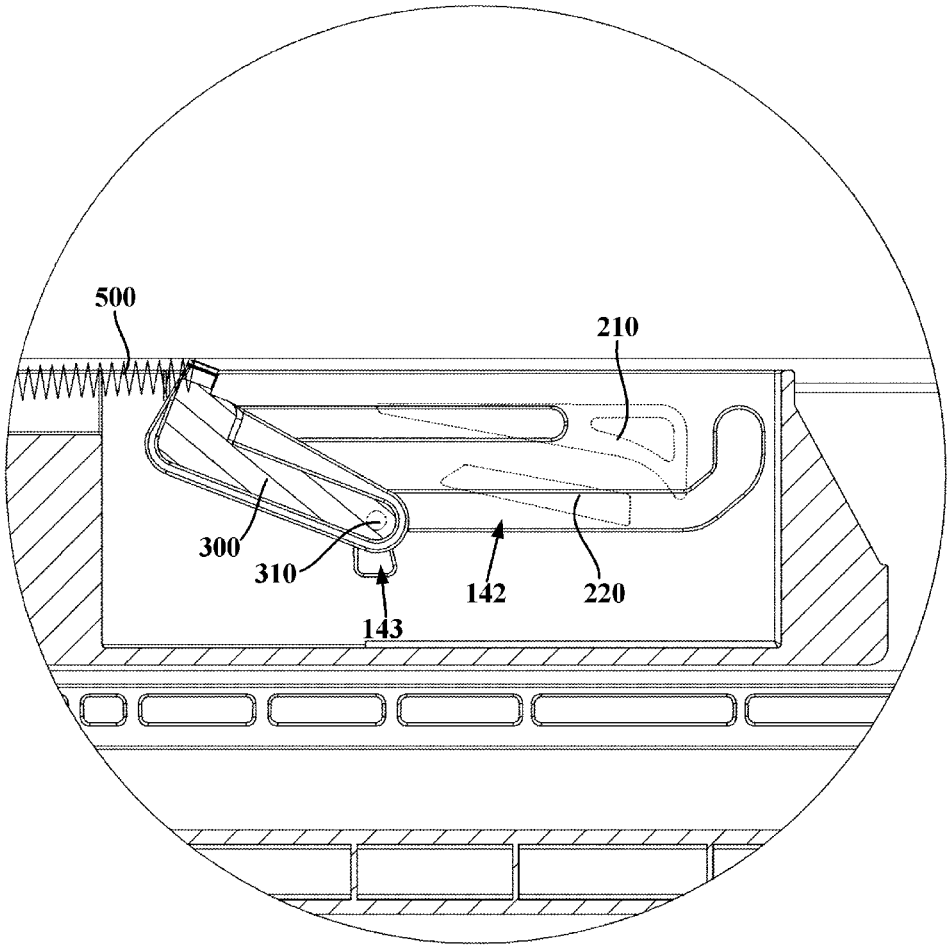
FIG. 16 is an enlarged view of a position C in FIG. 15.
Figure 17:
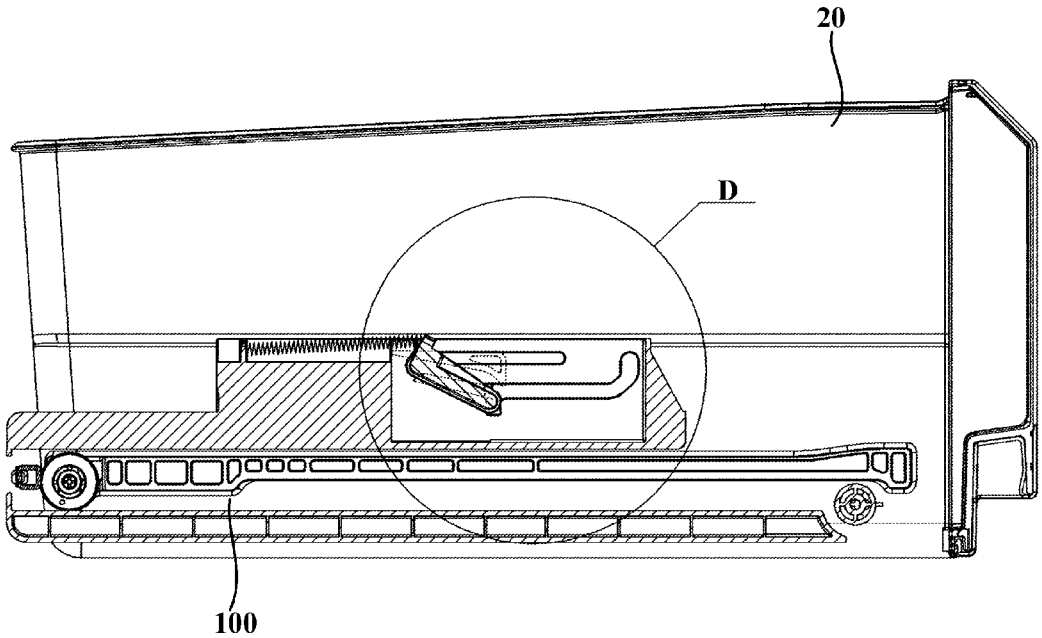
FIG. 17 is a sectional view of the drawer assembly at a moment when a front guide post is pressed into a rear vertical section.
Figure 18:
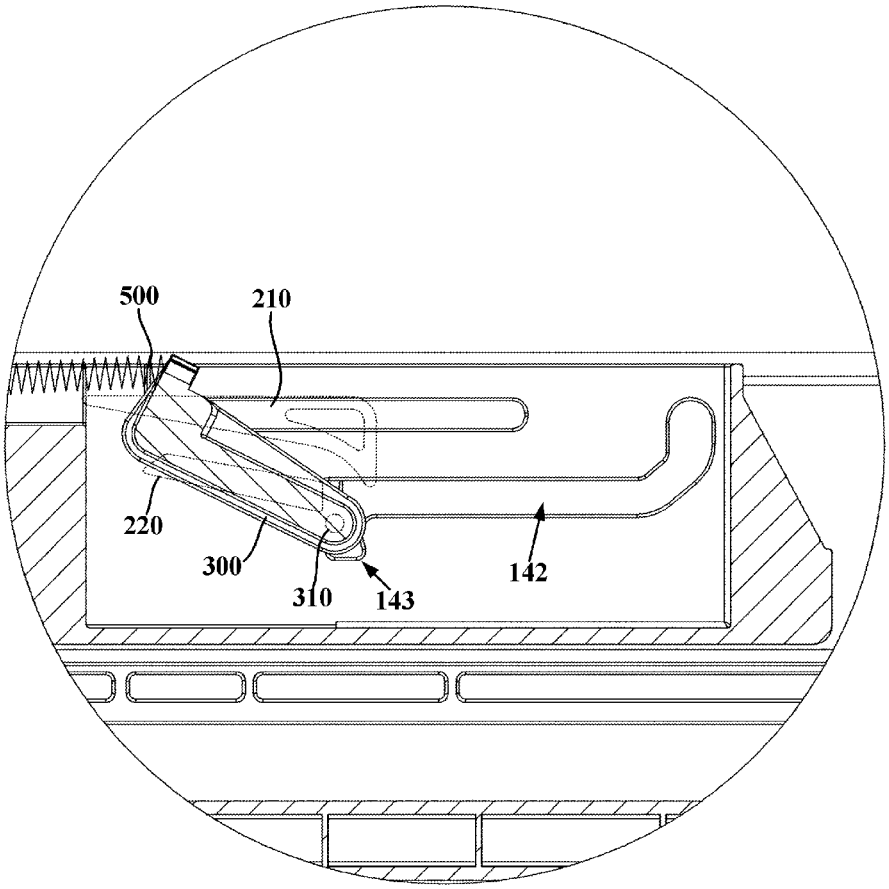
FIG. 18 is an enlarged view of a position D in FIG. 17.

(4) Under some abnormal conditions, the drawer 20 is in an abnormal open state. As shown in FIG. 15 and FIG. 16, the front guide post 310 is located at the rear end of the horizontal section 142. The upper guide strip 210 and the lower guide strip 220 are located in front of the front guide post 310. At this time, the mechanism has failed. The user needs to move rearward the drawer 20, so that the lower guide strip 220 is moved rearward to a position in contact with the front guide post 310. The lower guide strip 220 is moved rearward, and at the same time, the bottom edge of the lower guide strip presses downward the front guide post 310, so that the front guide post 310 enters the rear vertical section 143, so as to allow the lower guide strip 220 to cross the front guide post 310 (a state as shown in FIG. 17 and FIG. 18). Then, the connecting member 300 rotates under the effect of the elastic pre-tightening force, so that the front guide post 310 is moved upward so as to be located in front of the lower guide strip 220 again to return the state as shown in FIG. 13 and FIG. 14. The drawer 20 is in a normal closing state again, so that the user can conveniently complete the normal opening process later.

In some embodiments, as shown in FIG. 8, the support frame 100 is provided with an inner layer plate 120 and an outer layer plate 130 extending forward and rearward and parallel to each other. The inner layer plate 120 is closer to the drawer 20. The upper slide groove 150 and the lower slide groove 140 are formed in the inner layer plate 120. The upper slide groove 150 is formed in the outer layer plate 130. The upper slide groove 150 of the inner layer plate 120 is opposite to the upper slide groove 150 of the outer layer plate 130. The connecting member 300 is located between the inner layer plate 120 and the outer layer plate 130. The rear end of the connecting member is provided with two rear guide posts 320 extending leftward and rightward. The two rear guide posts 320 respectively enter one upper slide groove 150. The front end of the connecting member is provided with one front guide post 310 extending toward the drawer 20. The front guide post 310 passes through the lower slide groove 140, and protrudes out of the surface of the support frame 100, so as to be in contact with the upper guide strip 210 and the lower guide strip 220.

As described above, for the embodiment provided with two drawer assemblies, the support frame of the right support assembly of the drawer assembly located on the left side and the support frame of the left support assembly of the drawer assembly located on the right side are formed on the support frame base 510, so as to form the integral middle support assembly 50. The inner layer plates 120 of the two support frames 100 on the support frame base 510 of the middle support assembly 50 are formed on the support frame base 510. Additionally, the outer layer plates 130 of the two support frames 100 are of an integrally formed integral member, and are detachably located between the two inner layer plates 120. The two outer layer plates 130 and the support frame base 510 are in separated arrangement so as to facilitate mold design.

Hereto, it should be appreciated by those skilled in the art that although a number of exemplary embodiments of the present invention have been shown and described in detail herein, many other variations or modifications in accordance with the principles of the present invention can be directly ascertained or derived from the disclosure of the present invention without departing from the spirit and scope of the present invention. Therefore, the scope of the present invention should be understood and deemed to cover all such other variations or modifications.

What is claimed is:

1. A drawer assembly for a refrigerator, comprising:

a drawer, arranged in a storage compartment of the refrigerator in a way of being capable of being pushed and pulled forward and rearward between a front extreme position and a rear extreme position; and two support assemblies in left-right parallel arrangement, wherein each of the support assemblies comprises a support frame, and the support frame is fixed to an inner wall of the storage compartment, is provided on an inner side with a first slideway extending forward and rearward, and is provided on a rear portion of the inner side with an elastic tongue; and a left sidewall and a right sidewall of the drawer are respectively mounted on the first sideway of the support frame of one of the support assemblies in a forward and rearward slidable way, and the drawer assembly is configured as: when the drawer is moved rearward to approach to the rear extreme position, a rear end of the drawer pushes rearward the elastic tongue, so that the elastic tongue generates elastic deformation, thus allowing the elastic tongue to apply a forward elastic cushioning force to the drawer, wherein the left sidewall and the right sidewall of the drawer are respectively provided with an upper guide strip and a lower guide strip located below the upper guide strip, and the upper guide strip and the lower guide strip are both provided with a bottom edge gradually sloping downward from the rear side to the front side;

an upper slide groove and a lower slide groove are formed in the support frame, the upper slide groove extends forward and rearward, and the lower slide groove is provided with a front vertical section, a horizontal section extending rearward from a bottom end of the front vertical section, and a rear vertical section extending downward from a rear end of the horizontal section; and the support assembly further comprises:

a connecting member, wherein front and rear ends of the connecting member are respectively provided with a front guide post and a rear guide post with axes extending leftward and rightward, the front guide post extends into the lower slide groove, and the rear guide post extends into the upper slide groove; and an elastic element, applying a rearward elastic pre-tightening force to the connecting member; and the drawer assembly is configured as:

when the drawer is in a normal open state, the front guide post is clamped in the front vertical section, and the upper guide strip and the lower guide strip are located in front of the front guide post;

in a process of moving rearward the drawer, the upper guide strip is moved rearward, and at the same time, the bottom edge of the upper guide strip presses downward the front guide post, so that the front guide post leaves away from the front vertical section to enter the horizontal section and is abutted against a front edge of the lower guide strip, thus pushing the drawer to move rearward in an accelerated way under the effect of the elastic pre-tightening force;

in a process of moving forward and opening the drawer, the lower guide strip pushes forward the front guide post, so that the front guide post is clamped in the front vertical section again, and the drawer is continuously moved forward; and when the drawer is in an abnormal open state that the front guide post is clamped at the rear end of the horizontal section, the drawer is moved rearward, the lower guide strip is moved rearward, and at the same time, the bottom edge of the lower guide strip presses downward the front guide post, so that the front guide post enters the rear vertical section so as to allow the lower guide strip to cross the front guide post, and the front guide post is located in front of the lower guide strip again.

2. The drawer assembly according to claim 1, wherein the elastic tongue extends forward and rearward, a rear portion of the elastic tongue is fixed to the support frame, and a front portion gradually slopes upward and tilts from the rear side to the front side; and when the drawer is moved rearward to approach to the rear extreme position, the rear end of the drawer is in contact with a lower surface of the front portion of the elastic tongue so as to push rearward the elastic tongue, so that the front portion of the elastic tongue bends upward to apply the elastic cushioning force to the drawer.

3. The drawer assembly according to claim 2, wherein the rear portion of the elastic tongue extends along a horizontal plane, and an included angle between the front portion and the horizontal plane is in a range of 5° to 10°.

4. The drawer assembly according to claim 2, wherein a first pulley is respectively mounted at a rear end of the left sidewall and the right sidewall of the drawer;

when the drawer is moved forward and rearward, the first pulley rolls on an upper surface of the first slideway; and when the drawer is moved rearward to approach to the rear extreme position, the first pulley is in contact with the lower surface of the front portion of the elastic tongue so as to push rearward the elastic tongue.

5. The drawer assembly according to claim 4, wherein the left sidewall and the right sidewall of the drawer are respectively provided with a second slideway extending forward and rearward, and a front end of the inner side of the support frame is provided with a second pulley; and when the drawer is moved forward and rearward, the second pulley rolls along a lower surface of the second slideway so as to support the second slideway.

6. The drawer assembly according to claim 5, wherein a stop block is fixed to a rear end of the inner side of the support frame; and when the drawer is moved rearward to the rearward extreme position, the rear end of the drawer collides with the stop block, so that the drawer is incapable of being continuously moved rearward.

7. The drawer assembly according to claim 1, wherein the drawer assembly is further configured as:

in the process of moving rearward the drawer, when the front guide post leaves away from the front vertical section, a front end of the lower guide strip is located at a preset distance in front of the front guide post, so that after leaving away from the front vertical section, the front guide post is moved rearward under the effect of the elastic pre-tightening force to collide with the lower guide strip, and a prompt sound of drawer closing is given out.

8. The drawer assembly according to claim 1, wherein the support frame is provided with an inner layer plate and an outer layer plate extending forward and rearward and parallel to each other, the upper slide groove is respectively formed in the inner layer plate and the outer layer plate, and the lower slide groove is formed in the inner layer plate; and the connecting member is located between the inner layer plate and the outer layer plate, the rear end of the connecting member is provided with two of the rear guide posts extending leftward and rightward, the two rear guide posts respectively enter one of the upper slide grooves, and the front end of the connecting member is provided with one of the front guide posts extending toward the drawer.

9. A refrigerator, comprising a refrigerator body defining a storage component, and at least one drawer assembly according to claim 1, wherein the support frame of the support assembly is fixed to the inner wall of the storage compartment; and the left sidewall and the right sidewall of the drawer are respectively mounted on the first sideway of the support frame of one of the support assemblies in a forward and rearward translatable way.

* * * * *